US006522841B2

(12) United States Patent
Horikoshi

(10) Patent No.: US 6,522,841 B2
(45) **Date of Patent: *Feb. 18, 2003**

(54) IMAGE FORMING APPARATUS HAVING FANNING DEVICE FOR DELIVERED SHEET MATERIALS

(75) Inventor: Jun Horikoshi, Numazu (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/399,105

(22) Filed: Sep. 20, 1999

(65) Prior Publication Data

US 2001/0046398 A1 Nov. 29, 2001

(30) Foreign Application Priority Data

Sep. 21, 1998 (JP) ..... 10-265937

(51) Int. Cl.[7] ..... G03G 15/00
(52) U.S. Cl. ..... 399/45; 399/405; 271/211
(58) Field of Search ..... 399/405, 406, 399/92, 44, 45, 389; 271/211, 209

(56) References Cited

U.S. PATENT DOCUMENTS 3,502,407 A * 3/1970 Granzow et al.
4,405,125 A * 9/1983 Kulpa et al. ..... 271/195
5,445,372 A * 8/1995 Blaser et al. ..... 271/309

FOREIGN PATENT DOCUMENTS

| | | | |
|---|---|---|---|
| JP | 62-175786 | * | 8/1987 |
| JP | 1-079777 | * | 3/1989 |
| JP | 1-316757 | * | 12/1989 |
| JP | 4-217529 | * | 8/1992 |
| JP | 4-332678 | * | 11/1992 |
| JP | 7-277569 | * | 10/1995 |
| JP | 7-319370 | * | 12/1995 |
| JP | 9-301626 | * | 11/1997 |

* cited by examiner

*Primary Examiner*—Robert Beatty
(74) *Attorney, Agent, or Firm*—Fitzpatrick, Cella, Harper & Scinto

(57) ABSTRACT

An image forming apparatus includes an image forming device for forming images on sheet materials, a delivering device for delivering the sheet materials on which images are formed, a delivery tray for receiving the delivered sheet materials and a fanning device for fanning the sheet materials delivered from the delivering means to the delivery tray. The fanning device can change a blowing amount depending on a sheet material type.

15 Claims, 10 Drawing Sheets

IMAGE FORMING APPARATUS HAVING FANNING DEVICE FOR DELIVERED SHEET MATERIALS

BACKGROUND OF THE INVENTION

1. Field of the Invention

This invention relates to an image forming apparatus such as a photocopier, a printer, and the like capable of forming images on sheet materials by an image forming means made of an electrophotographic method, an ink jet method, or the like.

2. Description of Related Art

Color image forming apparatuses capable of high speed output of several tens of sheets per minute start to use practically these days. In such an apparatus, a method for forming full color images by transferring in an overlapping manner, e.g., four color toners of yellow, magenta, cyan, and black onto a sheet material according to the image information and by melting and mixing the toners by means of a fixing section has been used to form full color images. To mix the toners of four colors completely, the apparatus has a structure to apply heats in a large amount in a short time during fixing.

The sheet material thus formed with images is delivered onto a delivery tray located outside the apparatus by a delivery roller pair and is stacked on the tray.

However, the image forming apparatus of such a conventional technology embraces the following problems.

Because the sheet materials delivered on the delivery tray from the delivery roller pair right after the fixing process are ordinarily at a very high temperature, a large number of sheet materials heated at the high temperature is stacked on the delivery tray, so that toner images on the sheet materials may adhere to other sheet materials, or in some case, the sheet materials may adhere to each other, thereby rendering the image quality impaired.

In the apparatus of this type, a manual feed portion is provided for corresponding to various sheet materials (particularly, sheet materials having different thicknesses), and a sheet material conveyance route from the manual feed portion is frequently designed as to extend straightly. However, it was difficult to stack sheet materials orderly on the delivery tray in all cases, because a setting for stacking all of the sheet materials orderly on the delivery tray (e.g., conveyance speed or throwing angle of the delivery roller pair, angle of the delivery tray) is not easily, and because the sheet materials have different rigidity during delivery depending on image density, environments outside the apparatuses, kinds of the sheet materials, and the like.

To raise stacking easiness of the sheet materials having a smaller rigidity, many apparatuses have a structure that the delivery roller pair bends the sheet materials in the conveyance direction as the center of the sheet materials is curved downward, thereby delivering the sheet materials with certain rigidity.

However, where plastic sheet materials in a film form, like OHP sheets, are used, such sheet materials require a larger heat amount in comparison with the plain paper when toners are fixed, so that it is general to structure that a larger heat amount is given by rendering the sheet material conveyance speed slower at the fixing section. In such a situation, the toners after fixing tend to be cooled down slowly, and the sheet materials may be softened due to heats at the fixing section. Therefore, some trace of the delivery roller pair may be left on the sheet materials, or bending for giving rigidity may remain on the sheet materials and the sheet materials keep the shape without bending back even after sheet materials are cooled down.

It is therefore an object of the invention to provide an apparatus for preventing the image quality formed on the sheet materials from becoming inferior and for raising orderly stacking easiness of the sheet materials.

SUMMARY OF THE INVENTION

A representative structure of the invention to accomplish the above object is to include image forming means for forming images on sheet materials; delivering means for delivering the sheet materials on which images are formed; a delivery tray for receiving the delivered sheet materials; and fanning means capable of changing a blowing amount for fanning the sheet materials delivered from the delivering means to the delivery tray.

According to the above structure, the blowing amount for fanning the sheet materials delivered from the delivering means to the delivery tray can be changed, so that the image quality formed on the sheet material can be prevented from being impaired, and so that orderly stacking easiness of the sheet materials can be raised.

That is, when the sheet materials warmed by a fixing means are delivered onto the delivery tray, the air blow from the fanning means ensures fixation of the toner images upon cooling the sheet materials, so that the toner images can be maintained orderly even where the recorded sheet materials are stacked sheet by sheet on the delivery tray To prevent warmed sheets when delivered onto the delivery tray from being folded due to a difference in level between the delivering means and the delivery tray in association with the kinds of the sheet materials, delivering means of a conventional apparatus was required to deliver the sheet materials as bent. However, in this invention, the air blow from fanning means supports the sheet materials from the lower side of the materials, so that the sheet materials need not to be bent likewise the conventional apparatus, so that the apparatus can prevent the sheet materials from deforming.

Moreover, according to the conditions such as e.g., kinds of the sheet materials, the air blowing amount of the fanning means can be changed, so that the sheet materials can be stacked orderly.

DETAILED DESCRIPTION OF PREFERRED EMBODIMENTS

Figure 1:
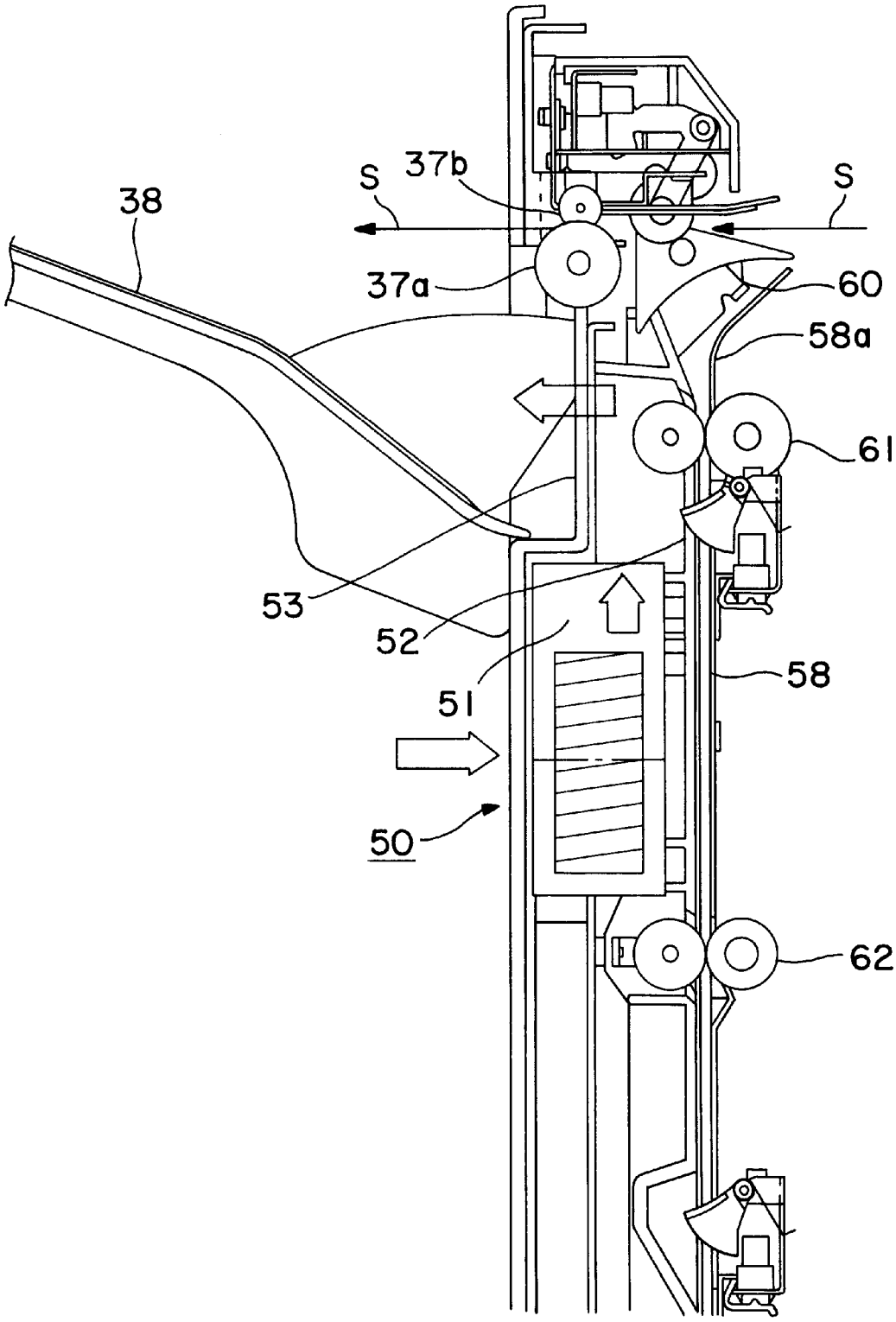
FIG. 1 is a cross-sectional illustration showing a schematic structure around a sheet material delivery section in an image forming apparatus according to the first embodiment.

Referring to the drawings, embodiments of an image forming apparatus to which this invention applies are described in detail. In the embodiments below, a color image forming apparatus is exemplified.

First Embodiment

Referring to FIG. 1 to FIG. 3, FIG. 9, and FIG. 10, an image forming apparatus according to the first embodiment is described in detail. It is to be noted that in the following description, a color image forming apparatus capable of forming full color images is exemplified as an image forming apparatus. First, a structural outline of the entire image forming apparatus is described, and then, the structure and operation about the delivery section and peripherals in the image forming apparatus is described in detail.

Figure 9:
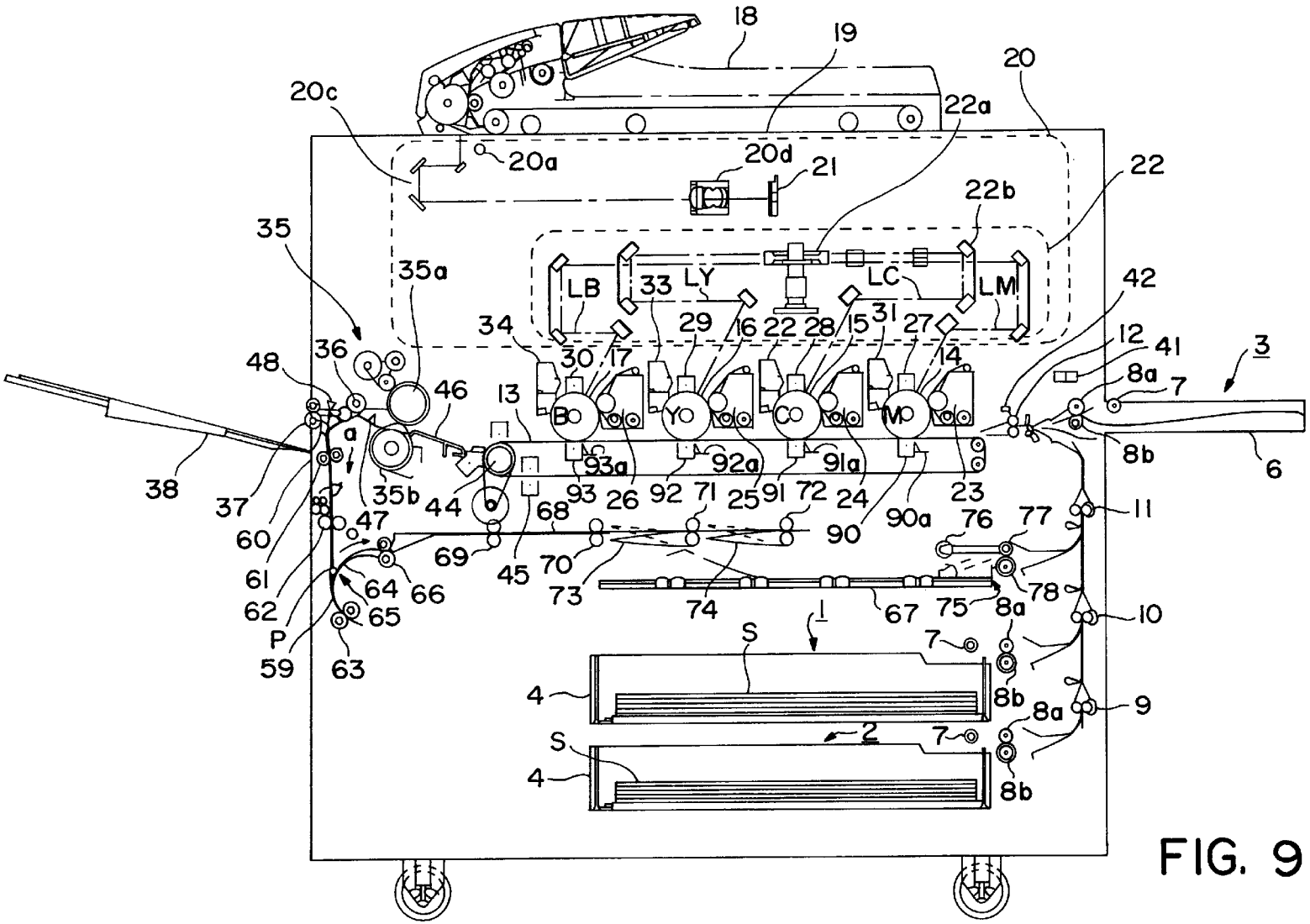
FIG. 9 is a schematic cross section showing a schematic structure of the entire image forming apparatus.

First, the entire structure of the color image forming apparatus shown in FIG. 9 is described.

The color image forming apparatus includes two cassette feeders 1, 2 and a single manual feeder 3, and these feeders 1, 2, 3 selectively feed the sheet material S.

In the feeders 1, 2, 3, sheets S stacked on cassettes 4, 5 or a tray 6 are picked up from the topmost sheet by a pickup roller 7. The sheet materials S picked up by the pickup roller 7 separates the topmost sheet only by a separation roller pair 8 made of a feed roller 8*a* and a retard roller 8*b*, and the sheet is sent to a register roller pair 12 which stops rotating.

In this case, the sheet materials S fed from the cassettes 4, 5 located remotely from the register roller pair 12 are fed to the register roller pair 12 upon relied by plural conveying roller pairs 9, 10, 11.

It is to be noted that in FIG. 9, numeral 41 is an environment sensor for measuring the environments of the apparatus (e.g., temperature, humidity, and the like), and numeral 42 is a paper thickness detection sensor for reading the thickness of the sheet material S from the moving amount of the feed roller 8*a*. Numeral 43 is a paper type detection sensor using both of a lever type sensor and a light transmission type sensor to detect the type of the sheet materials S.

The sheet material S sent to the register roller pair 12 momently stops moving when forming a prescribed loop where the front end of the sheet hits the nip of the register roller pair 12. This formation of the loop corrects obliquely feeding states of the sheet material.

A feeding belt (endless belt) 13 extending long for adhering and conveying the sheet materials S is installed in substantially the horizontal state on a downstream side of the register roller pair 12. The feeding belt 13 rotates in a counterclockwise direction. Plural photosensitive drums 14, 15, 16, 17 are arranged along in the sheet conveyance direction over the feeding belt 13 for carrying color toner images of different colors.

The photosensitive drum 14 located at an image forming section M on a most upstream side carries toner images of magenta color; the photosensitive drum 15 at an image forming section C next to the section M carries toner images of cyan color; the photosensitive drum 16 at an image forming section Y next to the section C carries toner images of yellow color; the photosensitive drum 17 at an image forming section B next to the section M carries toner images of black color.

In this color image forming apparatus, an original document automatic feeding apparatus 18 sequentially set plural original documents, not shown, at a prescribed position on an original document base (platen glass) 19. The images on the original document set on the original document base 19 (color images in this embodiment) are read by a reading optical system 20. The reading optical system 20 includes a light source 20*a* for radiating the original documents, a CCD device 21 for converting light into electrical signals upon receiving reflected light from the original document, a mirror unit 20*c* introducing the reflected light from the original document to the CCD device, a lens unit 20*d*, and so on. The color images read are separated into the respective color components of magenta, cyan, yellow, and black and stored temporarily in a graphic memory, not shown.

The image information stored in the graphic memory is written sequentially for each color on each of the photosensitive drums 14 to 17 rotating in the clockwise direction by a writing optical system 22 made of a polygon mirror 22*a*, a mirror unit 22*b*, and so on including a laser unit, not shown.

First, a laser beam LM starts projecting onto the photosensitive drum 14 located on the most upstream side based on images of the magenta component, thereby forming electrostatic latent images on the photosensitive drum 14. Toners of magenta color supplied from a developer 23 visualize those electrostatic latent images.

Subsequently, a laser beam LC starts projecting onto the photosensitive drum 15 based on images of the cyan component, thereby forming electrostatic latent images on the photosensitive drum 15. Toners of cyan color supplied from a developer 24 visualize those electrostatic latent images.

Then, after a prescribe time passes since the laser beam LC starts projecting onto the photosensitive drum 15, a laser beam LY starts projecting onto the photosensitive drum 16 based on images of the yellow component, thereby forming electrostatic latent images on the photosensitive drum 16. Toners of yellow color supplied from a developer 25 visualize those electrostatic latent images.

Then, after a prescribe time passes since the laser beam LY starts projecting onto the photosensitive drum 16, a laser beam LY starts projecting onto the photosensitive drum 17 based on images of the black component, thereby forming electrostatic latent images on the photosensitive drum 17. Toners of black color supplied from a developer 26 visualize those electrostatic latent images.

It is to be noted that primary chargers 27, 28, 29, 30 for uniformly charging the respective photosensitive drums 14, 15, 16, 17, cleaners 31, 32, 33, 34 for removing toners clinging on the photosensitive drums 14, 15, 16, 17 after toner images are transferred, and the like are provided.

The sheet material S in which oblique feeding state is corrected by sending the sheet material to the register roller pair 12 is further sent to the feeding belt 13 rotating in the counterclockwise direction by the register roller pair 12 which begins rotating at a timing as to meet the positions between the sheet front end and the toner images on the photosensitive drum 14 on the most upstream side.

During a process that the feeding belt 13 feeds, in the downstream side, the sheet material S transferred to the feeding belt 13, the sheet materials S sequentially passes through a transfer section located between the photosensitive drum 14 and a transfer charger 90, a transfer section located between the photosensitive drum 15 and a transfer charger 91, a transfer section located between the photosensitive drum 16 and a transfer charger 92, and a transfer section located between the photosensitive drum 17 and a transfer charger 93, thereby transferring in an overlapping fashion toner images of respective colors of magenta, cyan, yellow, and black on the sheet.

In FIG. 9, numeral 44 is a drive roller for rotatively driving the feeding belt 13; numeral 45 is a charger for charging the feeding belt 13; numerals 90*a*, 91*a*, 92*a*, 93*a* represent backup members for rendering the sheet materials S on the feeding belt 13 in contact with the respective photosensitive drums 14, 15, 16, 17 by pushing up the feeding belt 13.

The sheet material S passes through the transfer section between the photosensitive drum 17 on the most downstream side and the transfer charger 93 is sent to a fixing roller pair 35 by the feeding belt 13. During a process that the sheet material S passes through the nip of the fixing roller pair 35, the sheet material S is heated by a fixing roller 35*a*, and a pressure roller 35*b* presses the sheet material thereby fixing the transferred toner images onto the sheet surface.

The sheet material S passing through the fixing roller pair 35 with the already fixed images is transferred by the feeding roller pair 36 to the delivery roller pair 37, and the delivery roller pair 37 delivers the sheet material S on a delivery tray 38 located outside the apparatus.

It is to be noted that in FIG. 9, numeral 46 is a guide member for introducing the sheet material S to the nip portion of the fixing roller pair 35. Numeral 47 is a post-fixing sensor for detecting the delivery of the sheet material S from the fixing roller pair 35. Moreover, numeral 48 is a delivery sensor for detecting the sheet material S that is delivered outside the apparatus.

This image forming apparatus can form images on double sides. Hereinafter, the structure of the image forming apparatus is described along the streamline of the sheet material S during the double side mode operation. When the double side mode is designated, the fixing-processed sheet material S that passed through the fixing roller pair 35 is transferred to a reverse path 59 by passing through a vertical path 58. In this case, a flapper 60 opens up the vertical path 58, and the fixing-processed sheet material S is conveyed by feeding roller pairs 36, 61, 62 and a reverse roller pair 63 which can rotate in normal and reverse directions.

When the rear end of the fixing-processed sheet material S being conveyed in arrow a direction by the reverse roller pair 63 passes a point P, the reverse roller pair 63 rotates in the reverse direction, so that the fixing-processed sheet material S conveys in the direction of arrow b as the front end of the fixing-processed sheet material S goes ahead. In this operation, a toner image transferred side of the fixing-processed sheet material S faces up.

It is to be noted that at the point P, there provide a flexible sheet 64 for allowing entry of the sheet material S from the vertical path 58 to the reverse path 59 and for prohibiting entry of the sheet material S from the reverse path 59 to the vertical path 58, and a detection lever 65 for detecting the passage of the sheet rear end at the point P.

The fixing-processed sheet material S fed in the arrow b direction by reverse rotation of the reverse roller pair 63 is transferred to a delivery path 68 installed as to extend substantially horizontally over an intermediate tray 67 by a conveyance roller pair 66.

At the delivery path 68, plural delivery roller pairs 70, 71, 72 serving as an delivery opening are arranged in spaced with a prescribed interval along in the sheet conveyance direction. When the sheet material S having a large size in the conveyance direction is delivered, guide members 73, 74 are switched to move to respective positions as shown with phantom lines to render the delivery roller pair 70 serve as the delivery opening. When the sheet material S having an intermediate size in the conveyance direction is delivered, the guide member 73 is switched to move to the position shown with a solid line, and the guide member 74 is switched to move to the position shown with the phantom line, thereby rendering the delivery roller pair 71 serve as the delivery opening. When the sheet material S having a small size in the conveyance direction is delivered, guide members 73, 74 are switched to move to respective positions as shown with solid lines to render the delivery roller pair 72 serve as the delivery opening.

The fixing-processed sheet material S sent to the delivery path 68 is conveyed to the delivery roller pair 70 (or either of 71, 72) designated by a conveyance roller pair 69 and delivered to the intermediate tray 67 via the delivery roller pair 70 (or either of 71, 72). The front end of the fixing-processed sheet material S delivered to the intermediate tray 67 hits a stopper 75.

When the sheet materials S of a prescribed number are stacked on the intermediate tray 67, the original document automatic feeding apparatus 18 sets a subsequent original document on the original document base 19.

When a paper re-feeding signal is inputted to a CPU of the image forming apparatus, the sheet materials S stacked on the intermediate tray 67 are picked up sequentially by a pickup roller 76 from the topmost sheet. At that time, the stopper 75 pivotable around a shaft, not shown, as a center is pivotally moved to a restriction releasing position (at where sheet conveyance is not disturbed) from a sheet front end restriction position. The sheet materials S picked up the pickup roller 76 are separated sheet by sheet by means of a separation roller pair constituted of a feed roller 77 and a retard roller 78, and then sent to the image forming section.

Figure 10:
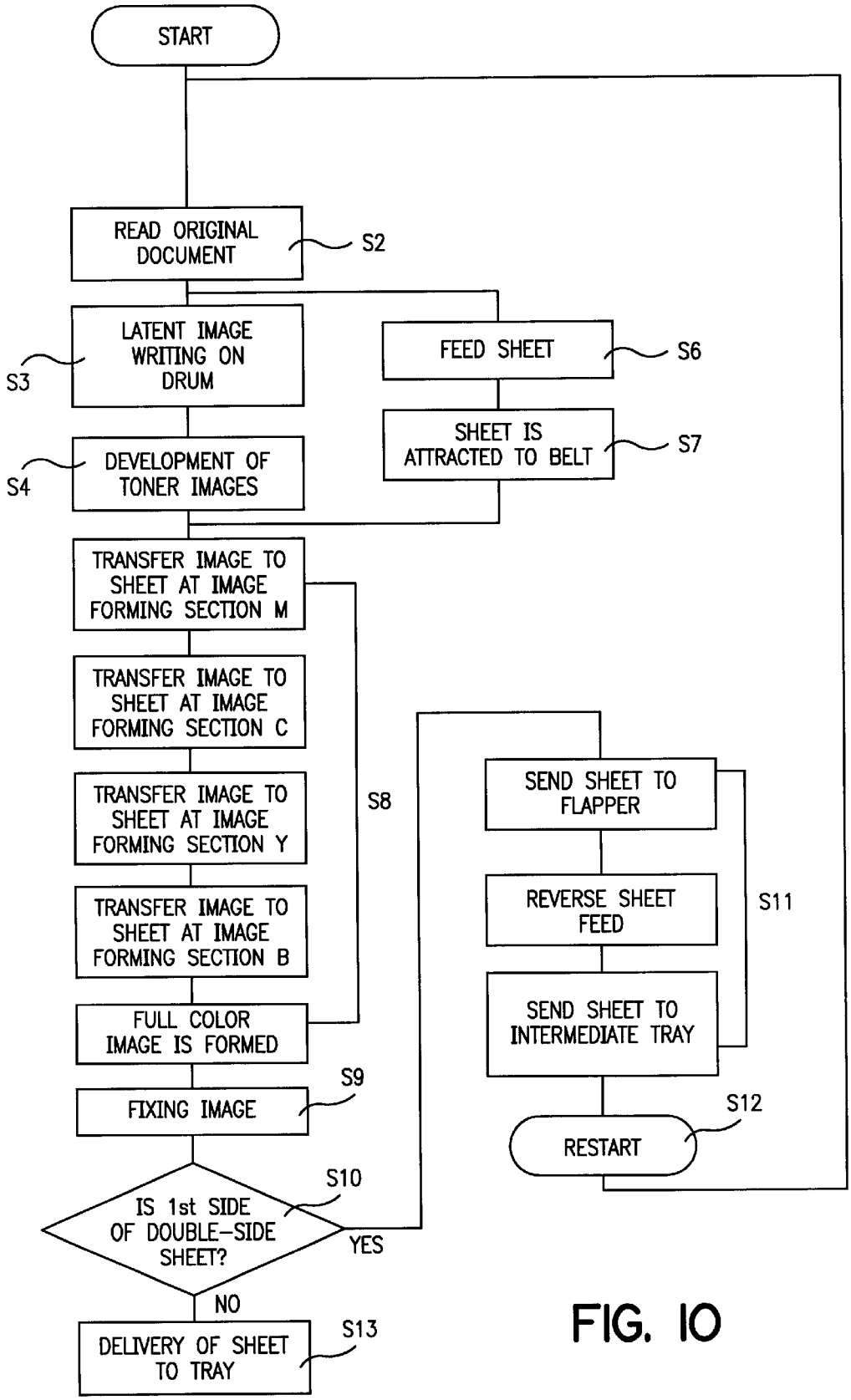
FIG. 10 is a flowchart showing image forming operation.

Now referring to FIG. 10, a representative flow of photocopying image formation operation in the image forming apparatus thus structured is described.

Where an original document is set on the original document base 19 and when a start key, not shown, is pushed, the light source 20*a* and the mirror unit 20*c* are moved along the original document surface. The reflection light from the original document is introduced to the mirror unit 20*c* and the lens unit 20*d* to the CCD device 21, and is converted to electrical signals sequentially (S2).

The image signal converted to the electrical signal is sent to the laser unit, not shown, and controls the light emission. The laser beams LM, LC, LY, LB corresponding to the image signal are scanned by the polygon mirror 22*a* and are radiated to the photosensitive drums 14, 15, 16, 17 of the image forming sections M, C, Y, B by each mirror unit 22*b* of each color component, thereby forming latent images (S3).

The photosensitive drums 14, 15, 16, 17 rotate in the clockwise direction in FIG. 9,and the latent images above are visualized as toner images by the developers 23, 24, 25, 26 (S4).

On the other hand, the sheet material S is sent to the register roller pair 12 by way of the feeding section from one of the cassette feeders 1, 2 and the manual feeder 3, which are preset or automatically selected upon pre-scanning operation (S6).

After measuring a timing to the image signal as described above, the sheet material is sent to the conveyance belt 13.

The conveyance belt 13 is rotating at a speed slightly lower than the feeding speed of the register roller pair 12 by the drive roller 44 and attracts the sheet material S by belt surface electronic charges given from a charger 45 (S7).

The sheet material S thus attracted is conveyed in synchrony with the image signals on the photosensitive drums 14, 15, 16, 17. At the image forming section M, the backup member 90*a* pushes up the conveyance belt 13, thereby rendering the sheet material S on the conveyance belt 13 in contact with photosensitive drum 14. The toner images on the photosensitive drum 14 are transferred onto a sheet material S by the transfer charger 90. Hereinafter, the toner images are transferred in substantially the same manner in the image forming sections C, Y, B, and therefore, a full color image is formed with toners of magenta, cyan, yellow, and black (S8).

The toner images on the sheet material S are sent to the fixing roller pair 35 by the guide member 46, and the nip portion made of the fixing roller 35*a* and the pressure roller 35*b* fixes the images with heat and pressure (S9).

The sequence is divided depending on the first side of the double sides or the other (S10). In the case of the double side output, the sheet material S is sent by the flapper 60 to the reverse double side feeding section and is sent to the reverse roller pair 63 by the feeding roller pairs 61, 62. The reverse roller pair 63 is reversed around the rear end of the sheet material S, and the sheet material S is sent in the direction of the feeding roller pair 62. The sheet material S thus sent is contained in the intermediate tray 67 by the conveyance roller 66 and the delivery roller pairs 70, 71, 72. When the sheet material has a large size, the position to be contained is switched in the intermediate tray 67 by means of the guide members 73, 74 according to the size (S11).

Figure 2:
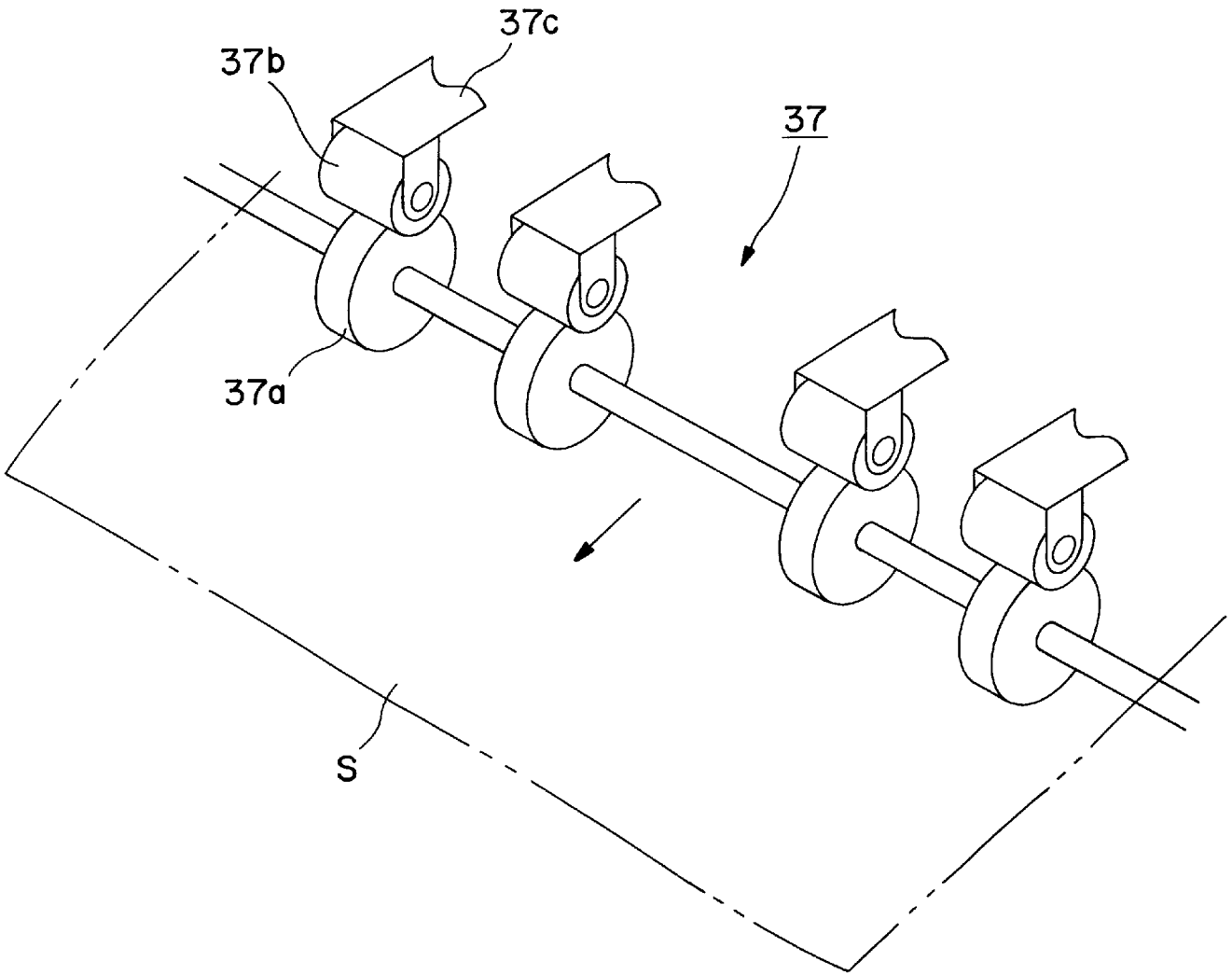
FIG. 2 is a perspective view showing a delivery roller pair.
Figure 3A:
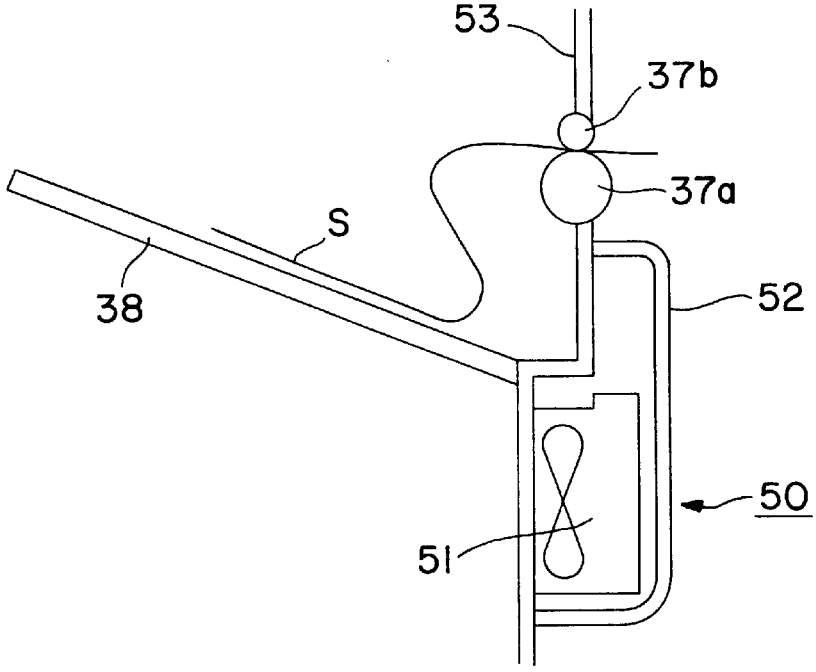
FIG. 3 is an illustration showing a delivery state of the sheet materials.
Figure 3B:
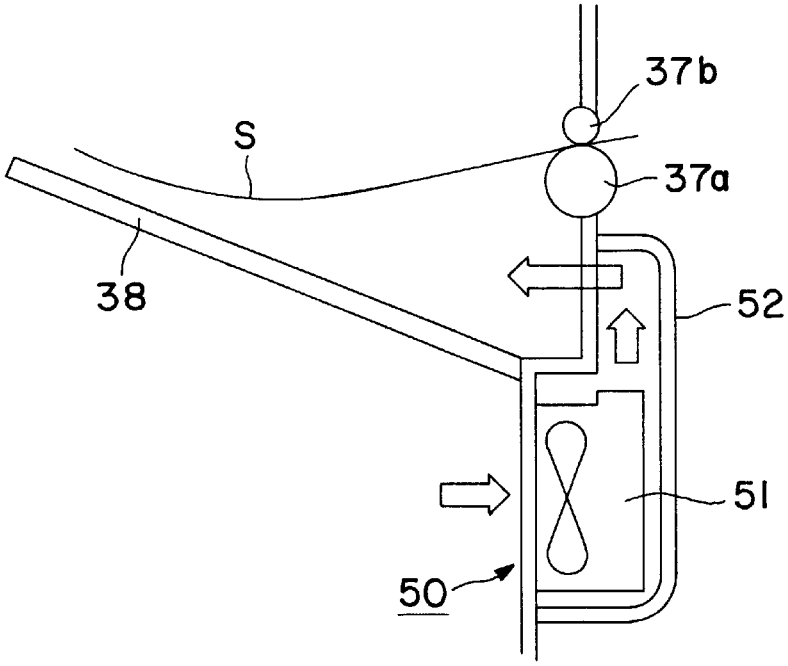

Referring to FIGS. 1 to 3, the structure and operation of the delivery portion and peripherals in the above image forming apparatus is described next in detail. FIG. 1 is a cross-sectional illustration showing a schematic structure around a delivery section in the image forming apparatus.

In FIG. 1, numeral 50 is a delivery fan portion as a fanning means; numeral 51 is a delivery fan; numeral 52 is a delivery fan duct; numeral 53 is a delivery portion cover. The delivery fan portion 50 sends air blow to the sheet materials S delivered from the delivery roller pair 37 to the delivery tray 38, and in this invention, the air blowing amount of the delivery fan portion 50 can be changed. The back surface of the delivery fan duct 52 also serves as a conveyance guide guiding the sheet materials S and forms the vertical path 58 for guiding the sheet materials S together with the guide plate 58*a* as a pair.

The delivery roller pair 37 constituting the delivering means, as shown in FIG. 2, is formed in a shape not giving a bending for providing rigidity in the conveyance direction to the sheet materials S as different from the conventional art.

The delivery roller 37*a* located on a drive side, in the delivery roller pair 37, is formed by inserting a rubber member to a shaft, and a driven roller 37*b* is made of a plastic and in pressured contact with the delivery roller 37*a* by a spring 37*c*. In respect with the widths in the axial direction of those members, the driven roller 37*b* is wider than the rubber portion of the delivery roller 37*a*, and the end of the driven roller 37*b* does not sandwich the sheet material S.

In operation when the sheet is delivered, the toner images formed on the sheet material by the image forming process thus described are sent to the fixing roller pair 35 upon guided by the guide member 46 and fixed to the sheet materials S by the nip portion made of the fixing roller 35*a* and the pressure roller 35*b* with heat and pressure. At that time, the fixing roller 35*a* starts to drive rotatively at a timing that approximately rotating twice before the sheet front end enters in the fixing nip portion. After approximately one rotating after the sheet rear end passes over the fixing nip portion, the fixing roller 35*a* stops. This operation will be repeated during successive copying. The delivery roller pair 37 is structured to he driven by the same drive source (fixing motor) for the fixing roller 35*a*, so that it rotates at the same timing.

The air introduced from the exterior of the apparatus by means of the delivery fan 51 blows out between the sheet material S delivered by the delivery roller pair 37 and the delivery tray 38 upon guided by the delivery fan duct 52 as an arrow in FIG. 1. That is, air blowing is made to the lower surface of the sheet material S as to support the sheet material S delivered onto the delivery tray 38 by the delivery roller pair 37 from the lower side of the material.

The apparatus of this type can handle film based sheet materials such as, e.g., various sheet materials like plain paper, and OHP sheets, and in this embodiment, such choice is identified from the paper source setting done by the user. and various processing in the apparatus can be made.

The operation for a film based sheet material such as an OHP sheet during delivery is described. When the sheet material S to which fixing has been made is delivered by the delivery roller pair 37, the sheet material S is softened without having rigidity from the delivery roller pair 37, the sheet material S may be bent and folded as shown in FIG. 3(*a*) due to friction to the delivery tray 38 (or sheet material delivered previously) if the blowing amount of the delivery fan 51 is small. Therefore, the blowing amount of the delivery fan 51 is increased to some extent or more to create an air layer between the sheet material S to be delivered and the delivery tray 38 as shown in FIG. 3(*b*), thereby rendering the lower surface never contact with the delivery tray 38 (or previously delivered sheet material) until the sheet material S is completely delivered. In this embodiment, a sirocco fan capable of obtaining a necessary blowing amount is used, which is driven by a biased voltage 24V. Therefore, good images can be obtained in free from traces of application to produce rigidity by the delivery roller pair 37.

Next, in operation of a sheet material such as plain paper during delivery, such traces by the delivery roller pair 37 do not raise problems so many because when sheet materials such as plain papers are to be fixed, the conveyance speed at the fixing section (fixing roller pair 35) is faster in comparison with the film based sheet material, and because the thermal capacity is so small and readily cooled down. However, if the bias voltage of the delivery fan 51 is unchanged at 24 V during delivery of the sheet material S such as the plain paper, the sheet material S, because of its light weight, is easily blown on the delivery tray 38 and makes the sheet materials worse in orderly stacking. In this embodiment, the bias voltage given to the delivery fan 51 is switched to 15 V as an air blowing amount for cooling the sheet material on the delivery tray 38 and for preventing the sheet material S from sticking when stacked. This switching produces good images and makes good orderly stacking property of the sheet materials S.

If the delivery fan 51 is operated continuously when successive copying operation is mad, the sheet material S may be pushed upward always by the air blown to the lower side of the sheet material S, thereby possibly making orderly stacking of the sheet materials worse. Therefore, the delivery fan 51 is stopped temporarily after sheet delivery in synchrony with drive of the delivery roller pair 37 (that is, the fixing section as described above). That is, in synchrony with turning on and off of the drive of the delivery roller pair 37, the delivery fan 51 operates and stops air blowing. This operation drops the sheet material S, which is being lifted by the air blowing of the delivery fan 51, thereby stacking the sheet materials S orderly.

As described above, when the film based sheet material like an OHP sheet is delivered upon fixing, the bias voltage given to the delivery fan 51 is set at 24 V to ensure adequate and necessary air blowing, to satisfy the stacking property when delivered, and to obtain good outputs in the image quality.

When the sheet material of a plain paper is delivered upon fixing, the bias voltage to the delivery fan 51 is set at 15 V to reduce the blowing amount, and the delivery fan 51 is operated in synchrony with drive of the fixing section, thereby preventing the sheet material from sticking over the delivery tray 38 during stacking as well as obtaining good outputs in orderly stacking.

Second Embodiment

Figure 4:
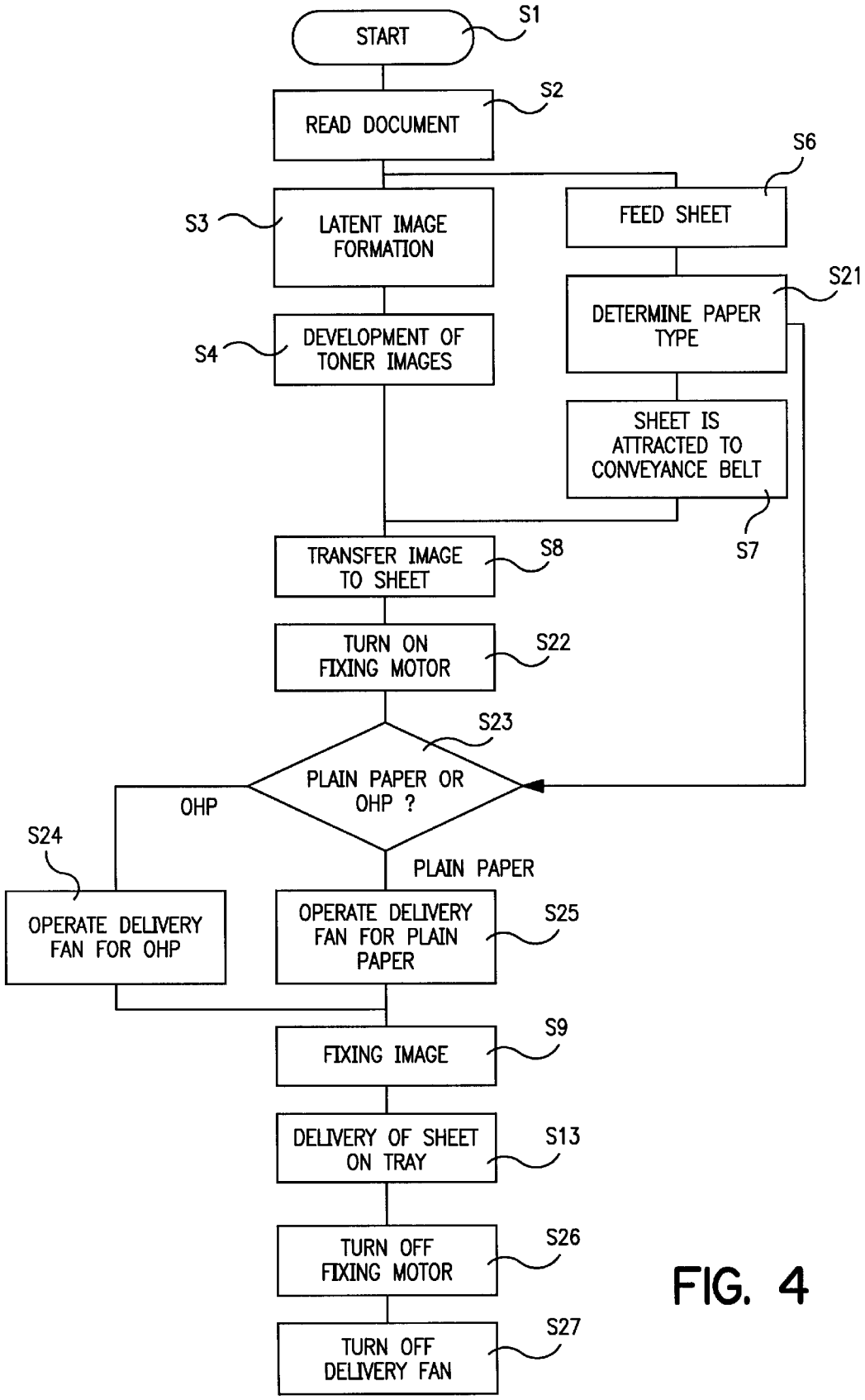
FIG. 4 is a flowchart showing a flow of image forming operation according to the second embodiment.

Referring to FIG. 4, an image forming apparatus according to the second embodiment is described. It is to be noted that the same reference numbers are assigned to members having the same functions as those in the above embodiment, and descriptions of such members are omitted.

In the first embodiment as described above, the structure that an air blowing amount of the delivery fan 51 is changed (switched) according to the selection by the user of the various settings for the sheet material is exemplified, but in this embodiment, a paper type detection sensor 43 is provided for paper type detecting means for detecting kinds, materials, and thickness of the sheet materials, and the air blowing amount is changed (switched) in accordance with the detected results of the paper type detection sensor 43. This makes the setting done by the user unnecessary, and makes the apparatus better.

Referring to FIG. 4, operation during sheet delivery is described. It is to be noted that the description of the same steps in FIG. 10 is omitted.

The sheet material S fed from the cassette feeders 1, 2 and the manual feeder 3 (S6), passes by the paper type detection sensor 43 as sheet type detecting means (S21). At the step, a judgment is made as to whether the sheet material is a film based sheet material such as an OHP sheet or the like or the sheet material such as plain paper. Subsequently, the toner images are transferred onto the sheet material S (S8), and after the transfer, the fixing motor is turned on after a predetermined time passes (S22). Based on the judged results of the above paper type detection sensor 43, the drive voltage of the delivery fan 51 is decided (S23), and the delivery fan 51 starts to operate in synchrony with the drive of the fixing motor (S24, S25). The sheet material S is subject to fixing at the fixing section (fixing roller pair 35)(S9), and the sheet material S is delivered onto the delivery tray 38 by the delivery roller pair 37 (S13). After a predetermined time passes, the fixing motor is turned off, and the delivery fan 51 stops operating in synchrony with this (S27).

According to the above structure and operation, the apparatus can obtain the same effects as those in the first embodiment without user's setting for paper type.

Third Embodiment

Figure 5:
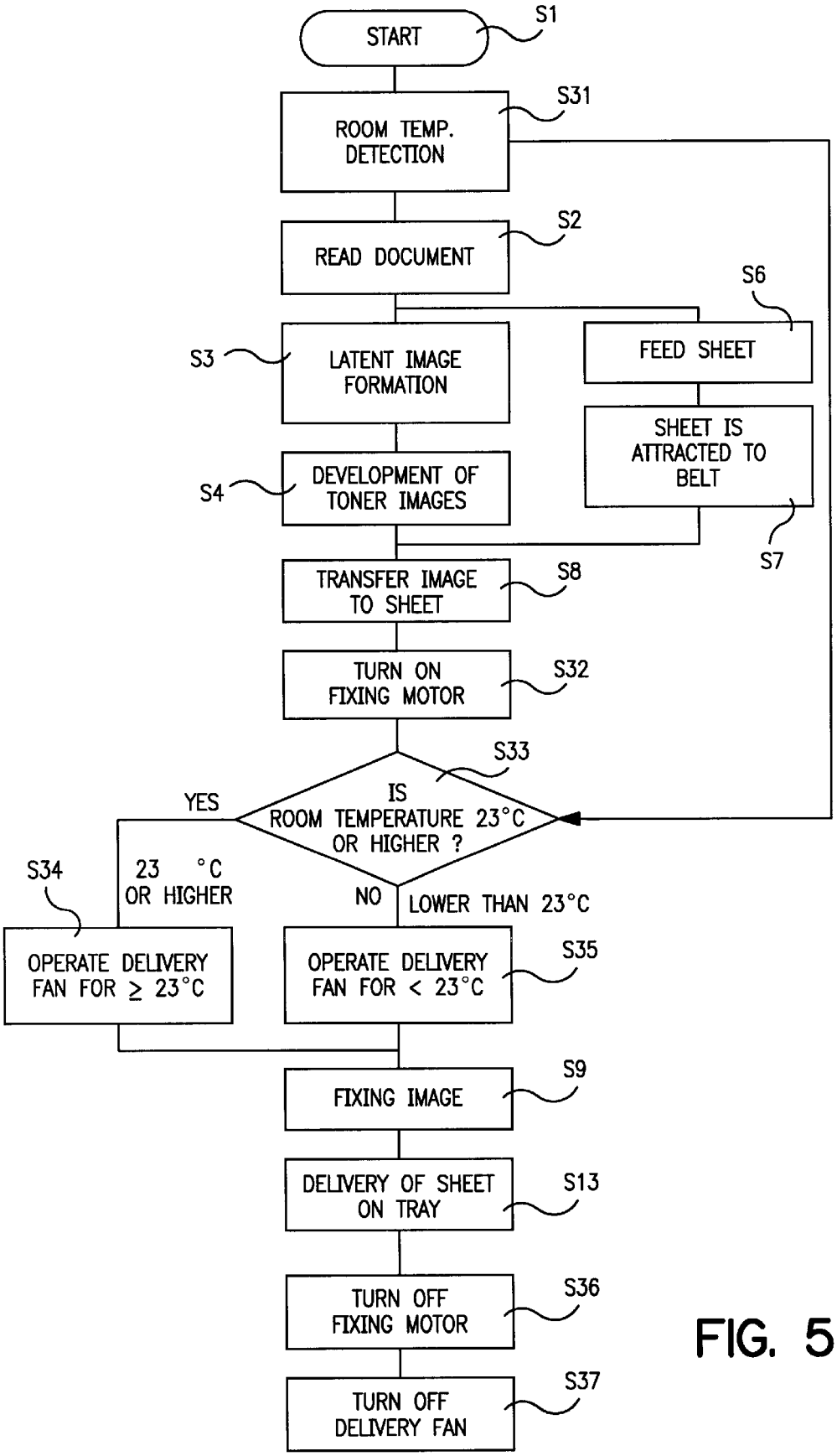
FIG. 5 is a flowchart showing a flow of image forming operation according to the third embodiment.

Referring to FIG. 5, an image forming apparatus according to the third embodiment is described. It is to be noted that the same reference numbers are assigned to members having the same functions as those in the above embodiment, and descriptions of such members are omitted.

Sticking of sheet materials such as plain paper or the like on the delivery tray while the sheet materials are stacked is remarkable where the environment in the room is generally at a high temperature and a high humidity. Conversely, when the room temperature is low, sticking can be prevented only by natural cooling down, and in some case, a delivery fan may be unnecessary. If the delivery fan does not operate, the sheet materials can be stacked more orderly than in the case where some blowing exists. Also it is advantageous to stop the delivery fan when unnecessary as much as possible, because it reduces the power consumption of the entire apparatus.

In this embodiment, while the sheet materials such as plain paper are stacked on the delivery tray, the delivery can 51 is operated in the same manner as in the first embodiment, according to the detected results of the environment sensor 41 as an environment detecting means for detecting the environment state, in a case where it is equal to or more than a preset room temperature previously sought by experiments, and the delivery fan 51 stops the operation in a case where it is lower than the preset room temperature. It is to be noted that in this embodiment, the boundary temperature is sought experimentally, and it was set to about 23° C.

Referring to FIG. 5, the operation during sheet delivery is described. It is to be noted that the description of the same steps in FIG. 10 is omitted.

When the user starts copying or printing (S1), the environment sensor 4*d* detects the room temperature at which this apparatus is placed, concurrently with other operations (S31). Subsequently, toner images are transferred onto the sheet materials S (S8), and after the transfer ends, the fixing motor is turned on after a predetermined time passes (S32). Herein, based on the detected results of the environment sensor 41, it is judged whether the room temperature is equal to or higher than 23° C, and the drive voltage of the delivery fan 51 is decided (S33) as well as the delivery fan 51 starts to operate in synchrony with the fixing motor. When the room temperature is equal to or higher than 23° C, the delivery fan 51 drives with the drive voltage of 15 V (S34), and when the room temperature is lower than 23° C, the delivery fan 51 does not operate (S35). Subsequently, the sheet material S is subject to fixing at the fixing section (the fixing roller pair 35) (S9), and the sheet material is delivered on the delivery tray 38 by the delivery roller pair 37 (S13). After a predetermined time passes, the fixing motor is turned off (S36), and in synchrony with this, the delivery fan stops operation (S37).

This advantageously allows the sheet materials to be stacked further orderly and the power consumption of the entire apparatus to be reduced.

Fourth Embodiment

Referring to the drawings, an image forming apparatus according to the fourth embodiment is described. It is to be noted that the same reference numbers are assigned to members having the same functions as those in the above embodiment, and descriptions of such members are omitted.

Sticking of the sheet materials such as plain paper on the delivery tray during stacking is more remarkable generally as the image density (=toner coating amount) is higher. Conversely, ordinary original documents made of texts may not need any delivery fan. If such a delivery fan is not operated, the sheet materials can be stacked more orderly in comparison with a situation where air blowing in a small amount is available. By stopping the unnecessary delivery fan as much as possible, it is advantageous to reduce the power consumption of the entire apparatus.

In this embodiment, when the sheet materials such as plain paper are stacked on the delivery tray, the toner amount (density) transferred to the sheet material S is detected by a video count amount of the image information sent to the writing optical system 22 including the laser unit. When the toner amount is equal to or more than an amount previously sought by experiments, the delivery fan 51 is operated in substantially the same manner as the first embodiment as described above, and when the toner amount is less than the amount previously sought, the operation of the delivery fan 51 is stopped.

Figure 6:
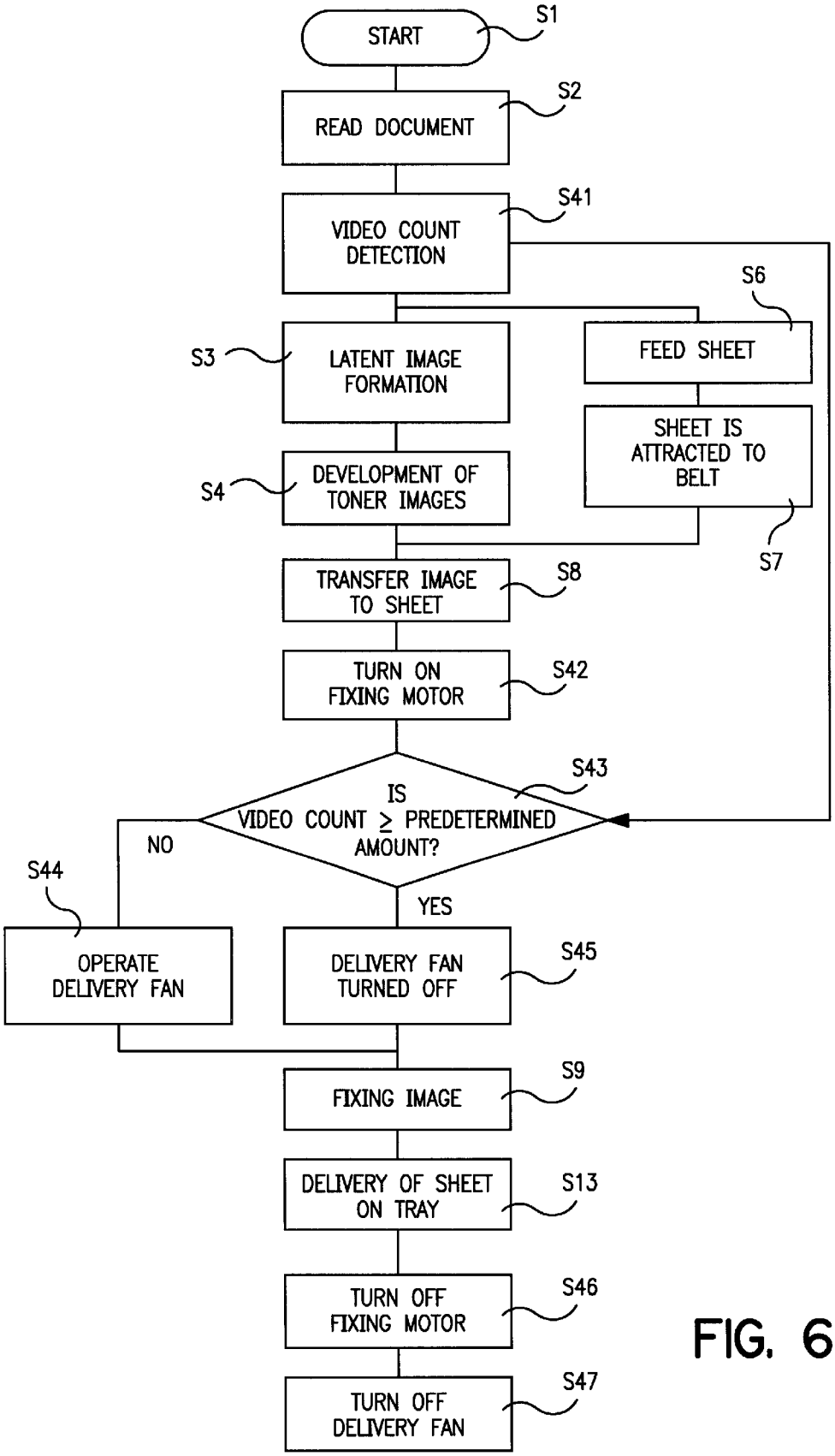
FIG. 6 is a flowchart showing a flow of image forming operation according to the fourth embodiment.

Referring to FIG. 6, operation during sheet delivery is described. It is to be noted that a description of the same steps as in FIG. 10 is omitted.

Where an original document image is read by the reading optical system 20 (S2), the reflection light from the original document is introduced into the CCD device 21 and converted into electrical signal. The toner amount (density) transferred to the sheet materials S is detected by the video count amount of the image signal sent to the writing optical system 22 decided by the read images, density controls done by a control portion, or the like (S41). Then, the toner images are transferred to the sheet materials S (S8), and after the transfer, the fixing motor is turned on after a predetermined time passes (S42). Based on the judged result of the above toner amount, it is judged as to whether the amount is equal to or more than the prescribed amount or not, and upon determining the drive voltage of the delivery fan 51 (S43), the operation of the delivery fan 51 starts in synchrony with the fixing motor. If the result of the toner amount judgment as described above is equal to or more than a predetermined amount, the delivery fan 51 is operated (S44), and the delivery fan 51 remains turned off if the results is equal to or less than the predetermined amount (S45). Subsequently, the sheet material S is subject to fixing section (the fixing roller pair 35) (S9), and delivered onto the delivery tray 39 by the delivery roller pair 37 (S13). After a predetermined time passes, the fixing motor is turned off (S46), and the delivery fan 51 stops operating in synchrony with this (S47).

According to this operation, the sheet materials can be stacked orderly on the delivery tray 38, and it is advantageous to reduce the power consumption of the entire apparatus.

Fifth Embodiment

Figure 7:
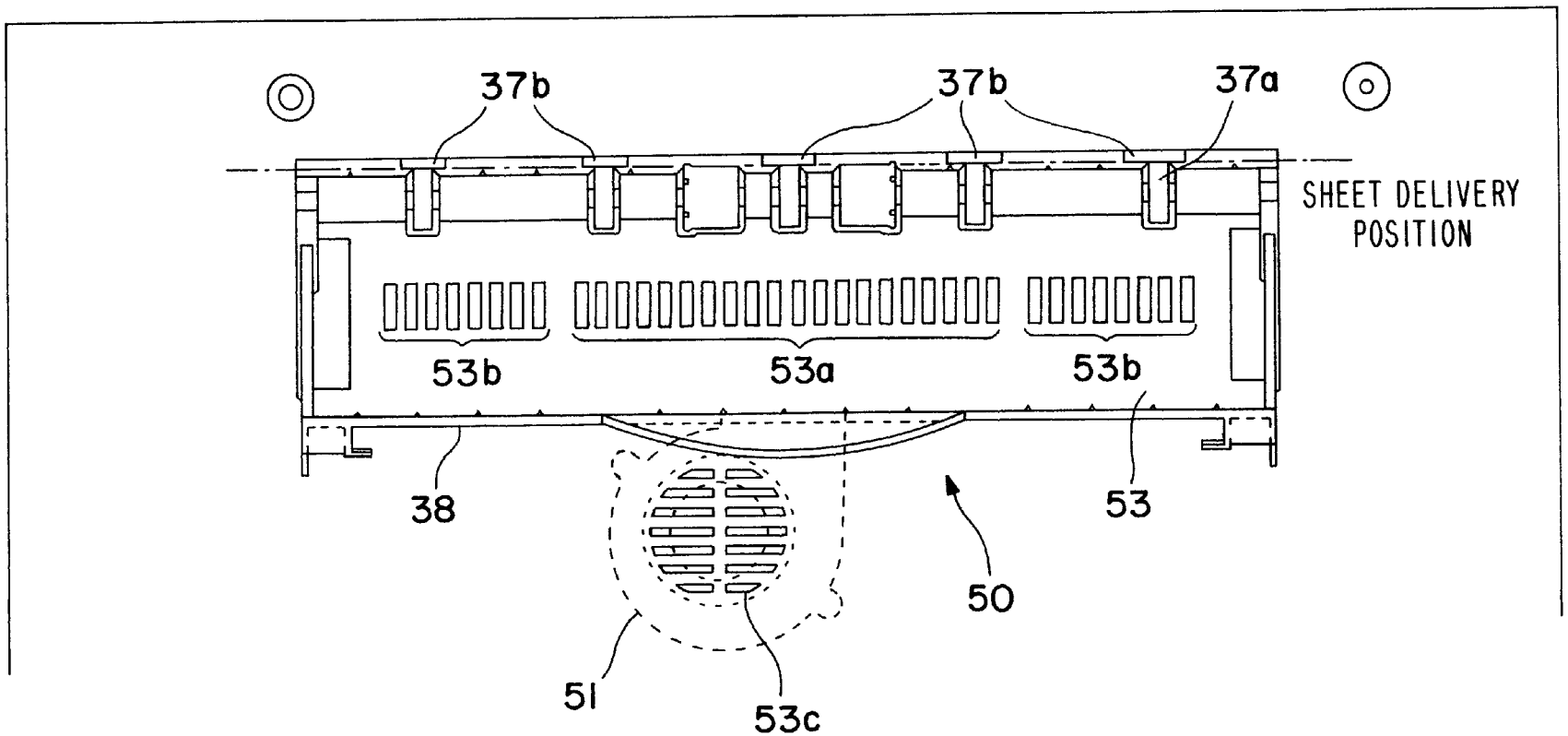
FIG. 7 is a structural view of a delivery fan portion when seen from a delivery tray side according to the fifth embodiment.
Figure 8:
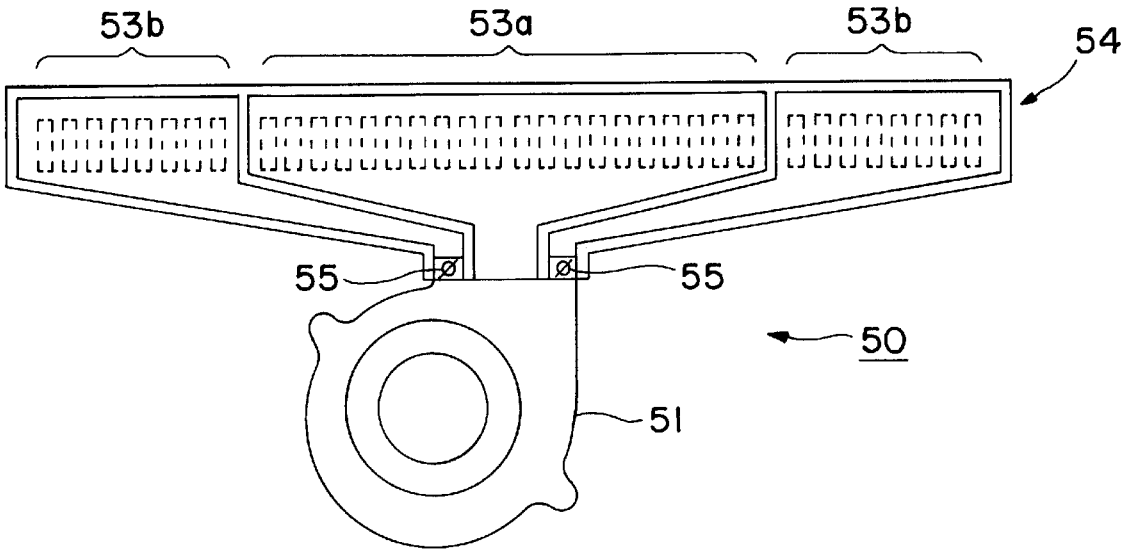
FIG. 8 is a schematic view of the delivery fan portion according to the fifth embodiment.

Referring to FIGS. 7, 8, the image forming apparatus according to the fifth embodiment is described. It is to be noted that the same reference numbers are assigned to members having the same functions as those in the above embodiment, and descriptions of such members are omitted.

As shown in FIG. 7, the delivery fan 51 intakes outer sir through an intake opening 53*c* formed in the delivery portion cover 53, and blows out air from fan orifices 53*a*, 53*b* located between the sheet delivery position and the delivery tray 38. It is to be noted that the delivery fan 51 and the fan orifices 53*a*, 53*b* are connected with each other by a delivery fan duct 52 (see, FIG. 1).

Since there are the sheet materials in various sizes used in the image forming apparatus such as photocopiers and printers, if the fan orifices 53*a*, 53*b* of the delivery portion cover 53 are open always, it is conceivable that about a half of the air thus blowing out does not blow the sheet materials where a sheet material having a smaller size (narrow width) is delivered (vertical sending of the sheet materials having A4 size or B5 size). Conversely, when only the fan orifice 53*a* is opened in consideration of the smaller size as described above (narrow width), air does not blow to edges of the sheet materials when sheet materials having a large size (wide width) are delivered (e.g., A3 size).

In this embodiment, according to the width size (the length in a direction perpendicular to the sheet conveyance direction) of the sheet materials, the opening width of the fan orifice can be changed to change the air blowing amount.

As shown in FIG. 8, the delivery fan 51 is connected to the duct 54, and in the duct 54, three air flowing passages are formed corresponding to the fan orifices 53*a*, 53*b* (two portions) in the duct 54. In a flowing passage corresponding to the fan orifice 53*b*, a small electromagnetic valve serving as fan orifice changing means is formed and structured to be capable of cutting off the air flowing.

In this embodiment, the sheet materials are categorized into two groups in association with widths of the sheet materials. Hereinafter, they are referred to as a small size (A4 portrait, B5 portrait) and a large size (A3 portrait, B4 portrait).

In this apparatus, a sheet size is determined at a time when images are formed, by setting of the sheet size by the user or by a function to decide the proper sheet size automatically upon reading the original document size.

When the above sheet size is a large size, the electromagnetic valve is opened to blow air from all of the fan orifices 53*a*, 53*b*. On the other hand, if the above sheet size is a small size, the electromagnetic valve is closed to blow air only from the fan orifice 53*a*.

This operation eliminates the disadvantages above described and allows a proper blowing width to be selected according to the sheet size.

In this embodiment, the sheet size is illustrated as divided into two categories: the large size and the small size, but this invention is not limited to this classification. Where a larger number of classes can be formed and where the number of the fluid passages in the duct 54 and the number of the electromagnetic valves 55 is increased, this apparatus can perform further suitably.

Although in this embodiment an example that the sole delivery fan 51 and the two electromagnetic valves are used is exemplified, substantially the same advantages can be obtained by using plural small size fans without use of the electromagnetic valve.

Other Embodiments

Although in the above embodiments exemplified are the apparatuses independently performing each essential members, the apparatus according to the invention can also perform not only individually but also in concert upon forming a combination of some of the essential members.

In the above embodiments, the photocopier is exemplified as an image forming apparatus, but this invention is not limited to this and can be other image forming apparatuses such as, for example, a printer, facsimile machine, and the like. The same advantages can be obtained where this invention applies.

In the above embodiments, the full color image forming apparatus is exemplified as an image forming apparatus, but this invention is not limited to this and can be a monochrome image forming apparatus. The same advantages can be obtained where this invention applies to such a monochrome image forming apparatus.

In the above embodiments, the electrophotographic method is exemplified as a recording method, but this invention is not limited to this and can be other recording methods such as an inkjet method or the like.

What is claimed is:

1. An image forming apparatus comprising:

image forming means for forming images on sheet materials;

delivering means for delivering the sheet materials on which images are formed;

a delivery tray for receiving the delivered sheet materials;

a return delivery means for returning the sheet materials to the image forming means to form images on the other side of the sheet materials, the return delivery means diverging below the delivery means;

a delivery portion cover forming a part of the apparatus exterior;

fanning means capable of changing a blowing amount for fanning the sheet materials delivered from the delivering means to the delivery tray, the fanning means disposed between the delivery portion cover and the return delivery means, and having an intake opening which takes in air from outside of the image forming apparatus, a fan orifice disposed between the delivering means and the delivery tray, and a fan duct connecting the intake opening and the fan orifice; and sheet type detecting means for detecting a type of sheet materials, wherein the fanning means changes the blowing amount in accordance with the detected type from the sheet type detecting means.

2. The image forming apparatus according to claim 1, wherein the delivering means has a delivery roller pair for nipping at least the sheet materials to convey the sheet materials without bending, in a direction perpendicular to the conveyance direction, the sheet materials.

3. The image forming apparatus according to claim 1, wherein the fanning means starts and stops blowing in synchrony with starting and stopping of operation of the delivering means.

4. The image forming apparatus according to claim 1, further comprising density detecting means for detecting the density of images formed on the sheet materials, wherein the fanning means changes the blowing amount in accordance with detected results of the density detecting means.

5. The image forming apparatus according to claim 1, wherein the fanning means has fan orifice changing means capable of changing the width of the fan orifice, wherein the fanning means changes the blowing amount in accordance with the width of the sheet materials in a direction perpendicular to the conveyance direction of the sheet materials.

6. An image forming apparatus comprising:

image forming means for forming images on sheet materials;

a delivery roller pair for delivering the sheet materials on which images are formed by said image forming means;

a delivery tray for receiving the sheet materials delivered by said delivery roller pair;

a fan capable of changing a blowing amount for fanning the sheet materials delivered from the delivery roller pair to the delivery tray; and a sheet type detecting means for detecting a type of the sheet materials, wherein said fan changes the blowing amount in accordance with the detected type from the sheet type detecting means.

7. An image forming apparatus according to claim 6, wherein said fan blows air to a lower surface of the sheet materials delivered from said delivery roller pair to said delivery tray.

8. An image forming apparatus comprising:

image forming means for forming images on sheet materials;

delivering means for delivering the sheet materials on which images are formed;

a delivery tray for receiving the delivered sheet materials;

fanning means capable of changing a blowing amount for fanning the sheet materials delivered from the delivering means to the delivery tray; and sheet type detecting means for detecting a type of the sheet materials, wherein the fanning means changes the blowing amount in accordance with detected results of the sheet type detecting means.

9. The image forming apparatus according to claim 8, wherein said sheet type detecting means detects thickness of the sheet materials.

10. An image forming apparatus comprising:

image forming means for forming images on sheet materials;

delivering means for delivering the sheet materials on which images are formed;

a delivery tray for receiving the delivered sheet materials;

fanning means capable of changing a blowing amount for fanning the sheet materials delivered from the delivering means to the delivery tray; and environment detecting means for detecting an environment condition outside the apparatus, wherein the fanning means changes the blowing amount in accordance with detected results of the environment detecting means.

11. The image forming apparatus according to claim 10, wherein said environment detecting means detects temperature outside of the apparatus.

12. An image forming apparatus comprising:

image forming means for forming images on sheet materials;

delivering means for delivering the sheet materials on which images are formed;

a delivery tray for receiving the delivered sheet materials;

fanning means capable of changing a blowing amount for fanning a lower surface of the sheet materials delivered from the delivering means to the delivery tray; and sheet type detecting means for detecting a type of the sheet materials, wherein the fanning means changes the blowing amount in accordance with the detected type from the sheet type detecting means.

13. An image forming apparatus according to any one of claims 1 to 9, the image forming apparatus further comprising image fixing means disposed at an upstream side of the delivering means for heating the sheet materials to fix the images which are formed thereon.

14. An image forming apparatus comprising:

image forming means for forming an image on sheet materials;

a delivery roller pair for delivering the sheet materials on which images are formed by said image forming means;

a delivery tray for receiving the sheet materials delivered by said delivery roller pair; and a fan capable of changing a blowing amount for fanning the sheet materials delivered from the delivery roller pair to the delivery tray, wherein the blowing amount of said fan is changed according to the setting of the selection of the type of the sheet materials by the user.

15. An image forming apparatus according to claim 14, wherein said fan blows air to a lower surface of the sheet materials delivered from said delivery roller to said delivery tray.

* * * * *

UNITED STATES PATENT AND TRADEMARK OFFICE

CERTIFICATE OF CORRECTION

PATENT NO. : 6,522,841 B2
DATED : February 18, 2003
INVENTOR(S) : Horikoshi

It is certified that error appears in the above-identified patent and that said Letters Patent is hereby corrected as shown below:

Column 1,
Lines 24 and 66, “heats” should read -- heat --; and
Line 48, “easily,” should read -- easy, --.

Column 4,
Lines 34 and 41, “prescribe” should read -- prescribed --.

Column 8,
Line 10, “he” should read -- be --;
Line 24, “user.” should read -- user, --;
Line 47, “problems so many” should read -- so many problems --; and
Line 65, “mad,” should read -- made, --.

Column 11,
Line 57, “sir” should read -- air --.

Signed and Sealed this

Eighteenth Day of November, 2003

JAMES E. ROGAN
*Director of the United States Patent and Trademark Office*